United States Patent [19]

Siniscalchi

[11] Patent Number: 4,849,044

[45] Date of Patent: Jul. 18, 1989

[54] PROCESS FOR THE PRODUCTION OF A PADDING WEB HAVING A HIGH DEGREE OF THERMAL INSULATION USABLE FOR CLOTHING AND FURNISHING

[76] Inventor: Lucio Siniscalchi, Via Milano, 53, 22059 Robbiate (Como), Italy

[21] Appl. No.: 76,594

[22] Filed: Jul. 23, 1987

Related U.S. Application Data

[63] Continuation-in-part of Ser. No. 793,160, Oct. 31, 1985, abandoned.

[30] Foreign Application Priority Data

Nov. 5, 1984 [IT] Italy ..... 23448 A/84

[51] Int. Cl.[4] ..... B44C 1/17; B32B 3/00; D04H 1/58

[52] U.S. Cl. ..... 156/233; 156/241; 156/296; 427/209; 427/393.5; 428/288

[58] Field of Search ..... 156/230, 233, 238, 241, 156/247, 248, 249, 276, 305, 296, 298; 162/156, 172, 181.9; 428/228, 352, 344, 288, 914, 227; 427/209, 393.5, 421

[56] References Cited

U.S. PATENT DOCUMENTS

| | | | |
|---|---|---|---|
| 3,496,057 | 2/1970 | McCluer | 156/233 |
| 4,153,494 | 5/1979 | Oliva | 156/241 |
| 4,282,283 | 8/1981 | George et al. | 428/251 |
| 4,368,232 | 1/1983 | Morioka et al. | 428/228 |
| 4,374,890 | 2/1983 | Shimizu et al. | 428/344 |
| 4,551,383 | 11/1985 | Siniscalchi | 156/344 |

FOREIGN PATENT DOCUMENTS

| | | | |
|---|---|---|---|
| 0767714 | 2/1957 | United Kingdom | 156/233 |

*Primary Examiner*—Michael W. Ball
*Assistant Examiner*—Louis Falasco
*Attorney, Agent, or Firm*—Bucknam and Archer

[57] ABSTRACT

A process for the production of padding layers having a high degree of thermal insulation, and particularly suitable for use in clothing and furnishing, comprises the steps of producing, by means of carding machines, a layer or web comprising a mixture of polyester fibres with silicone treated fibers of the same or different nature. This layer or web is then resin coated on one side with a mixture of sticky plastic adhesives which, when polymerized, form a very soft and elastic film; on the other side of the same layer a non-sticky adhesive is sprayed or otherwise applied and the thus treated web is then subjected to a calendering operation at a temperature varying between predetermined limits. Subsequently, a layer of metal particles embedded in synthetic resins is applied to one or both sides of the said layer in such a way as to form a thermal barrier operable to reduce the transmission of heat by radiation and convection through the layer itself.

5 Claims, 2 Drawing Sheets

PROCESS FOR THE PRODUCTION OF A PADDING WEB HAVING A HIGH DEGREE OF THERMAL INSULATION USABLE FOR CLOTHING AND FURNISHING

This is a continuation in part of the U.S. Pat. No. 4,551,383 granted on Nov. 5, 1985 to the U.S. patent application Ser. No. 06/793,160, now abandoned, which is an improvement of the same Applicant.

BACKGROUND OF THE INVENTION

In this patent there is disclosed a process for the production of padding in synthetic or other fibres, the improvement comprising the steps of:

first producing a web including a layer obtained by carding a mixture of fibres of polyester or other fibres with silicone treated fibres of diverse nature and origin;

treating one side of said web with a mixture of bonding agents of stickly plastic consistency which, when polymerised, create a very soft and elastic film;

spray-applying on the opposite side of said web from said one side thereof another type of bonding agent, of different nature, which is not sticky;

passing said web, thus treated, through a calender composed of two or more cylinders; and heating said cylinders whereby to cause said sticky plastic bonding agent to adhere to the facing roller in the region of separation of said web from said rollers such that said layer of fibres is caused partially to separate to create air spaces therein.

By suitably regulating the pressure and the temperature of the cylinders, a desired and adjustable reduction of thickness can be obtained, and, simultaneously, the effect of the adhesion of the plastic side of the adhesive layer as the layer is being separated from the cylinder, there takes place a slight reinflation which creates an "air chamber" or air pocket within the layer.

An advantage of this process is that the formation of the air chamber or air pocket is also favoured by the presence of the silicone treated and therefore slippery fibres. This process makes it possible to reduce the desired thickness paddings having very high weight per square meter, which constitutes a considerable advantage as far as use of the padding for garments is concerned.

Another advantage is represented by the possibility of obtaining by means of the calendering operation, more or less any thickness of finished padding from a single given material starting thickness by appropriately varying the temperature and pressure of the cylinder.

In particular this process for the production of padding can be performed on webs of layers comprising a mixture of polyester or other fibres with silicone treated fibers of different nature and origin.

This mixture of fibers, by means of carding machines, is formed into a layer, which is resin bonded with a mixture of adhesives for the purpose of making it more compact and for fixing the nap.

More specifically, there are used two mixtures of adhesives: a first sticky plastic adhesive which, when polymerised, creates a very soft and elastic film on one side of the padding; on the other side, there is sprayed another type of adhesive, of different nature, which is not sticky.

The product which results from this has a soft and voluminous aspect; however, for the requirements of fashion or for other requirements, there exists the necessity of having the product in layers of high weight per square meter, and therefore of high insulating property, but reduced thickness. To achieve this the layer of padding, produced as described above, is made to pass through a calender, composed of two or more cylinders heated to a chosen temperature. In particular, one of the cylinders or of each pair of cylinders if there is more than one pair (the lower cylinder as viewed in the drawings) is completely smooth and made of metal, whilst the other is clad with a material of a different nature, which is not smooth.

By suitably adjusting the pressure and the temperature and arranging that the sticky plastic side of the layer faces towards the coated cylinder, the desired reduction in the thickness is obtained, and simultaneously, by the effect of the adhesion of the sticky plastic side of the layer itself to the cylinder in the region of separation from the cylinder, there occurs a slight reinflation which creates an "air chamber" or air pocket.

Alternatively, of course, the said calender could be constituted by entirely metal cylinders, or other non-clad materials. The presence of a layer, however thin, of adhesive, on one face of the layer, makes this latter adhere, at least over a certain section, to the facing cylinder. In practice, the expansion of the compressed material caused by this adhesion is controllable, and serves to create, in the material itself, zones of discontinuity, which reduce its specific weight and increase its thermal resistance. Thus it can be seen that the product thus obtained is able to offer a high thermal resistance without by this presenting excessive thickness.

The following table summarized, by way of example, the different insulation properties of three products, all produced starting from layers of superimposed cohered fibres of polyester, and all having the same weight per unit of surface area but of course all having different thicknesses, the thinnest being the product according to the invention of said granted U.S. Pat. No. 4,551,383.

| Product | Traditional Wadding | Stitched Wadding | Production of the invention |
|---|---|---|---|
| Thickness | 0,6 mm | 0,6 mm | 0,6 mm |
| Weight in grammes | 30 | 50 | 120 |
| Insulation Traditional wadding + 100 | 100 | 130 | 290 |

This above-described padding has thermal insulating characteristic which are a significant improvement over those encountered in paddings of known type which, among other things, are generally rather thick and therefore do not lend themselves well to application in the field of clothing; moreover, such known padding materials do not have such good thermal insulation characteristics as can be achieved with the padding material of the applicant's earlier patent application referred to above.

SUMMARY OF THE INVENTION

A primary object of the present invention is that of further and significantly improving the thermal insulation characteristics of the padding described hereinabove.

Another object of the invention is to provide a product which is more compact and manageable than hithertofore known padding materials.

A further object of the invention is to make available a padding material which can be used more conveniently in the field of clothing, or furnishing than prior art padding materials.

A particular object of the present invention is that of providing padding which will have exceptional thermal insulation characteristics without however relinquishing the characteristics of softness, elasticity and pleasantness to the touch typical of padding materials generally.

Yet another object of the present invention is that of providing a process which can be performed with simplicity and rapidity.

Still another object of the present invention is to provide a process for producing padding materials which allows utilisation of the products thereof which are not incompatible with their application in the field of clothing.

A still further object of the present invention is that of providing a process which leads to the production of a product which, as well as having significantly improved characteristics, is more aesthetically pleasing than previously known paddings and which, moreover, is more easily workable than prior art padding materials.

The process according to the invention for the production of padding having a high degree of thermal insulation, and which is usable in the field of clothing and furnishing comprises the steps of forming, by means of carding machines, a layer obtained from a mixture of polyester fibres with silicone treated fibres, resin coating the said layer on one side thereof with a mixture of sticky adhesives having a plastic consistency, which upon polymerisation, form a very soft and elastic film, spraying or otherwise coating, on the other side of said layer, a non sticky adhesive, calendering the thus treated layer at a variable temperature, and subsequently applying to one or both sides of said layer a further layer of metal particles embedded in synthetic resin.

Further characteristics and advantages of the process for the production of padding, which constitutes the subject of the present invention will be more clearly understood from a study of the following description, in which reference is made to the attached drawings, provided purely by way of nonlimitative example only.

DESCRIPTION OF THE PREFERRED EMBODIMENTS

Figure 1:
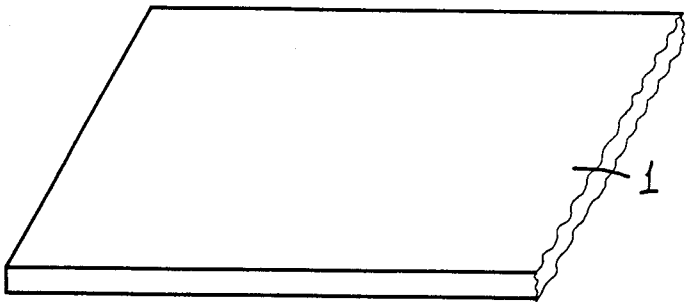
FIG. 1 shows a starting layer comprising a web of mixed fibres including polyester fibers and silicone treated fibres of the same or a different nature.
Figure 2:
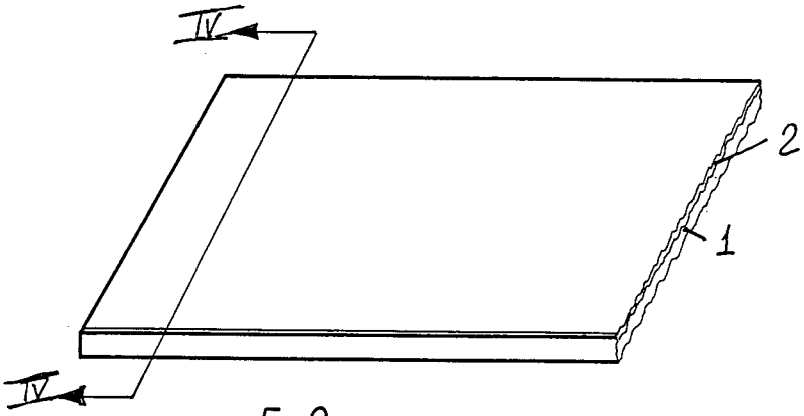
FIG. 2 shows the same web after the application, to one of its faces, of a layer of metal particles embedded in synthetic resin.
Figure 3:
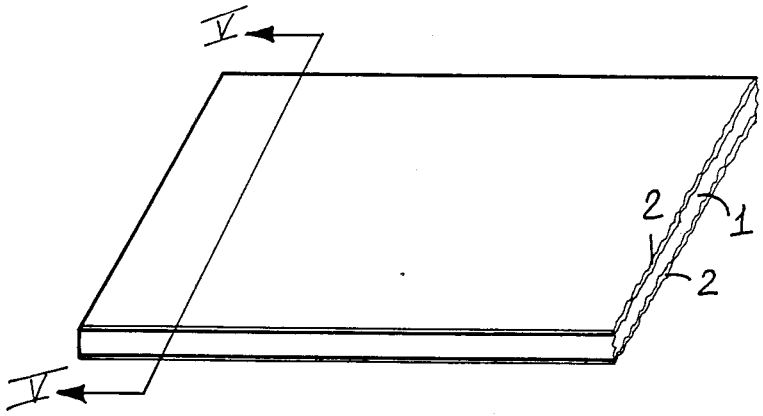
FIG. 3 shows the same web after the application, to the other of its faces, of a further layer of metal particles embedded in a synthetic resin.
Figure 4:
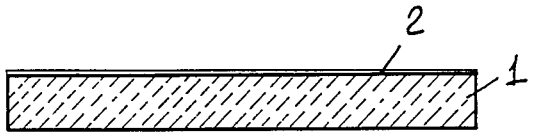
FIGS. 4 and 5 are cross sections taken on the lines IV—IV and V—V of FIGS. 2 and 3 respectively.
Figure 5:
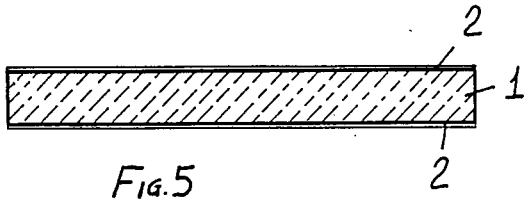

With particular reference to the various figures of the attached drawings, the process of the invention for the production of padding with a high degree of thermal insulation comprises the production first of a layer or web 1 obtained in accodance with the teaching of the Applicant's earlier U.S. Pat. No. 4,551,383 referred to hereinabove, and then onto this web 1 there is applied a layer 2 of metal particles embedded in synthetic resin as shown in FIG. 2. Simultaneously or sequently a second layer of metal particles embedded in a synthetic resin may be applied to the opposite face of the web 1 as shown in FIG. 3. More precisely, the or each said layer is constituted by an acrylic or polyurethane or vinyl resin, which may be in emulsion or in a solvent, pigmented with aluminium or any other metal powder, in such a way as to confer a metallised appearance to the surface of the product. If emulsions are used, these latter will be in aqueous phase, whilst if the said resins are in solution, the solvents used may be esters, ketones, dimethylformamides, aromatic hydrocarbons and the like. The said layer of resin and metallic powders may be applied on the web of padding by means of metallisation in a high vacuum, by direct or via "transfer" stamping, or by means of spreading or spraying, which may also be in direct form or by "transfer" techniques.

Direct metallisation of a surface of the padding, however, presents not insignificant practical and economic problems. Such a process, in fact, is substantially discontinuous and, moreover, the material (wadding) to be subjected to this process is very voluminois so that the length of the rolls of material which can be introduced into a conventional metallisation installation is necessarily limited and the full metallisation capacity of the installations themselves thus cannot be adequately utilised. An excessively low productivity is therefore experienced.

More advantageously a "transfer" process involving the preliminary metallisation of a film of plastic material is envisaged. Preferably a polyester film with a thickness in the region of 12–15 μm is used in such process. For this process the film is preliminarily treated with an anti-adhesive lacquer, and then the metal is applied to it by any known metallisation technique for example by spreading or spraying suitable emulsions or solutions of the desired metal particles. The metal is then transferred to the web of wadding by means of a hot calendering operation using a calender operating, for example, at a speed of around 30 m/min and at a temperature of 100°–140° C. and with a specific pressure of 10–30 mg/cm$^2$. With a process such as that indicated above it is possible easily to obtain metallisation of different colours; including silver, gold and bronze, with very important aesthetic effects from a commerical point of view.

The application of a metallised layer by spreading or spraying onto a substrate is a well known technique. This comprises spreading or spraying an emulsion, or better (since this allows aesthetically more pleasing results to be obtained) a solution of resins in organic solvents in which metal pigments (generally aluminium) and organic colourants have been dispersed to impart a different colouration to the solution itself.

The most suitable resins for this purpose for the particular application of metallising onto the subject synthetic fibre wadding, are as already indicated acrylic, vinyl and polyuretane resins.

The following examples illustrates, purely by way of example, various typical solutions which may be formed by means of said resins.

| Acrylic resin: | |
|---|---|
| PARALOID B72 (a trademark for methyl esters of the acrylic acid) | ppm 60 (Rohm & Haas) |
| cellulose acetobutyrate | ppm 90 (Bayer) |
| metal pigment | ppm 50 |
| organic pigment | ppm 0–5 |
| toluene | ppm 200 |
| ethyl acetate | ppm 100 |
| isobutyl acetate | ppm 100 |
| total solid 33% | |
| viscosity 5–10,000 cP. | |

In use it will of course be necessary to bring the solid content and the viscosity to values suited to the particular system of application.

| Vinyl resin: | |
|---|---|
| PARALOID A30 (a trademark for methyl esters of the methacrylic acid) | ppm 10 (Rohm & Haas) |
| VINYLITE VyHH | ppm 85 (Union Carbide) |
| celllulose acetobutyrate | ppm 5 (Bayer) |
| metal pigment | ppm 20 |
| toluene | ppm 50 |
| methyl ethyl ketone | ppm 150 |
| ethyl acetate | ppm 20 |
| isobutyl acetate | ppm 20 |
| total solid 33% | |
| viscosity 5–10,000 cP. | |
| Polyurethane resin: | |
| polyurethane resin | ppm 35 (Larithane Ms 132) |
| aromatic polyester | (Larim S.p.A.) |
| dimethylformamide | ppm 65 |
| metal pigment | ppm 50 |
| total solid 43% | |
| viscosity 8–120,000 cP. | |

Whilst acrylic resins are more suitable for application by spray, vinyl and polyurethane resins lend themselves greatly to application by spreading.

Spray application is effected according to known techniques and using known spray nozzles or heads. After drying, the material is calendered to improve the aspect of the wadding, at a temperature for example of 100°–120° C. at a speed of about 30 m/min, and a pressure of 10–30 mg/cm$^2$.

Application by spreading is considered more practical and more economically convenient, and in general spreading by so-called "transfer" or "off-set" techniques is preferred in that it permits more brilliant and technically more controllable and interesting results to be obtained. The technology for transfer or offset spreading is substantially known: this involves the application, to a suitably devised "release" (anti-adhesive) paper, which may have a polished, semi-polished, matt or embossed finish or other, a resin solution in the thickness considered most suitable (generally in thicknesses of 100–200 μm) using a roller-doctor blade system.

The spread layer of solution is put into contact with a web of wadding and the whole assembly passes into a drying furnace at 100°–180° C. in which the solvent is completely evaporated. At the output of the furnace the assembly is cooled; the wadding on which the resin has been deposited, by now completely dried, is separated from the release paper and would in rolls. The release paper is also wound up separately and re-utilised. The whole operation is conducted at a speed of between 10 and 50 m/min according to the type of resin and wadding and according to the desired characeristics of the finished product.

It is suitable at this point to make it clear that, whichever method of its application to the web of wadding the thickness of the layer can vary within wide limits in dependence on the final utilisation envisaged for the padding itself. Further, the metallisation operation can obviously be effected on any other type of padding for clothing and furnishing.

The layer which is obtained on the surface of the web of wadding is, preferably, several microns thick and such as to form a surface film having significant elasticity in such a way as not to prejudice in any way the typical characteristics of softness and suppleness of the padding. The application of the said surface layer is physically of significant importance in that it substantially forms a barrier layer which is largely impermeable to air from the outside (up to 80%) but such as not to retain moisture vapour or cause condensation within the layer.

The physical characteristics of the metallised layer are such that, when it is applied to the face which will be the outside of the padding (that is on the opposite face from that nearest to the body in a case in which the padding is to be utilised for clothing) it significantly reduces the transmission of heat by convection. The presence of an almost air impermeable layer, in fact, causes the creation within the layer of padding of a cushion or air pocket which remains almost static and which, consequently, constitutes a rotable thermal barrier not allowing the dispersion of heat towards the outside.

The padding thus formed also has notable improvements as far as the transmission of heat by radiation is concerned in that the layer of metal particles, preferably of aluminium, but which may be of other substances forms, in a sense, a heat reflective surface such that the heat within the padding layer is not transmitted by radiation to the outside, but reflected back towards the inside thus further increasing the insulating factor of the layer.

As far as the transmission of heat by conduction is concerned, the very small thickness of the metal particle-containing layer is such as not to cause appreciable variations in the heat transmitted by conduction.

The metallised layer which is formed on the surface of the wadding is suitably permeable to mositure so that possible condensation phenomena are avoided, which phenomena could result in the formation of condensation within the interior of the layer, which would be detrimental to the insulating properties of the padding in that the condensate would in practice fill cavities or zones which, otherwise, would be filled with air. The metallised layer, as well as being elastic and soft, thus permits any possible condensation or moisture which may form within the padding to escape therefrom thus contributing to an improvement in the health characteristics of the product.

Another important aspect of the invention is constituted by the fact that the metallised surface layer, being composed of metal particles embedded in a synthetic resin, has the function of conferring a greater compactness and dimensional stability to the padding layer thus formed, making this latter thus more easily workable (for example in the production of windcheater jackets and quilting) in that any fraying which might otherwise occur in correspondence with the cut edges is significantly reduced. Because of this the said metallised surface layer is able to facilitate the washing operations on the finished product as well as exerting a definite locking action on the surface fibres allowing the padding to be used with any type of fabric, even very light fabric, without the possibility of hairs, down or fibres escaping therefrom.

Moreover, the product obtained is very consistent, thus making it unnecessary to perform stitching through of the manufactured product, as was previously necessary in order to maintain the fabric and padding connected together.

Figure 6:
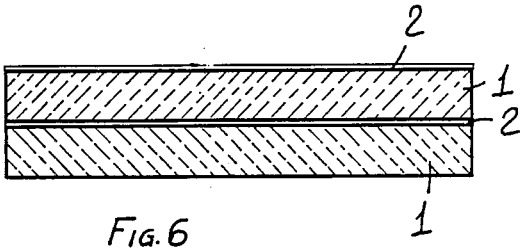
FIG. 6 is a cross section showing two superimposed layers treated on one side only.
Figure 7:
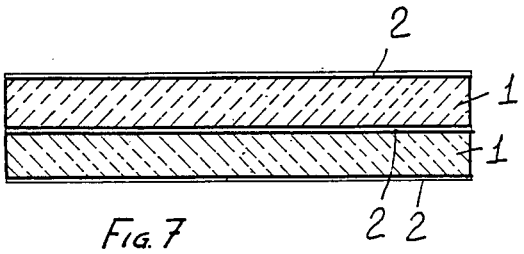
FIG. 7 is a cross section showing two superimposed layers treated on both sides.

Further, the layers of padding thus formed can be joined together in such a way as to provide a composite padding (as shown in FIGS. 6 and 7) comprising two or more layers, incorporating one or more thermal barriers within the thickness of the composite layer as well as one or more surface layer.

The presence of the metallised surface layer contributes, moreover, to improving the appearance and presentation of the product in that it presents a brilliant surface aspect due to the presence of the metal particles in the resin; the metal particles do not, however, prejudice the characteristics of softness to the tough and elasticity of padding.

From what has been explained hereinabove, and from observation of the various Figures of the attached drawings, the great functionality and practicality in use which characterises the padding of the invention will be apparent, particularly the high degree of the thermal insulation obtained by virtue of the presence of the surface layer of metal particles embedded in plastic resin.

The process of the invention has been described and illustrated hereinabove purely by way of indicative, but non-limitative example, and solely for the purpose of demonstration of the practicability and the general characteristics of the present invention, such that all those variations and modifications within the scope of an expert in the art and susceptible of being brought within the spirit and scope of the inventive concepts as defined in the following claims can be introduced thereto without departing therefrom.

I claim:

1. In a process for the production of a padding web having a high degree of thermal insulation usable for clothing and furnishing said web having two faces, said process comprising the steps of: providing a web comprising a layer obtained by carding a mixture of fibres of polyester or other fibres with silicone treated fibres of diverse nature and origin;

resin coating said web,on one face thereof, with a mixture of adhesives having a sticky plastic consistency which, when polymerized, form a soft elastic film;

spraying onto the opposite face from said one face of said web, a non sticky adhesive;

calendering the layer thus treated at a set temperature; the improvement of applying to at least one face of said web a surface layer of metal particles embedded in a synthetic resin film and further calendering said padding web, after drying of said layer of metal particles embedded in said synthetic resin film at a temperature from 100° to 120° C., a pressure from 10 to 30 $Kg/cm^2$ and a speed of about 30 m/min.

2. A process according to claim 1, wherein said synthetic resin film is prepared by the step of:

treating a film of synthetic resin with an antiadhesive lacquer, metallizing said film with a metal layer having a thickness in the range of 12–25 micrometers, and transferring said metallized film onto said web by means of said further calendering step.

3. A process according to claim 1, wherein said synthetic resin is one of acrylic resin, polyurethane and vinyl resin as a solution in a solvent comprising one of an ester, a ketone, a dimethylformamide and an aromatic hydrocarbon, said solution being composed by the following constituents:

| | |
|---|---|
| methyl esters of acrylic acid | ppm 60 |
| cellulose acetobutyrate | ppm 90 |
| metal pigment | ppm 50 |
| toluene | ppm 200 |
| ethyl acetate | ppm 100 |
| isobutyl acetate | ppm 1000 |

with a total solid contents of 33% and a viscosity in the range of 5–10,000 cP.

4. A process according to claim 1, wherein said solution is composed of the following constituents:

| | |
|---|---|
| methyl esters of methacrylic acid | ppm 10 |
| vinylite VyHH | ppm 85 |
| cellulose acetobutyrate | ppm 5 |
| metal pigment | ppm 20 |
| toluene | ppm 50 |
| methyl ethyl ketone | ppm 150 |
| ethyl acetate | ppm 20 |
| isobutyl acetate | ppm 20 |

with a total solid contents of 33% and a viscosity in the range of 5–10,000 cP.

5. A process according to claim 1, wherein said solution is composed of the following constituents:

| | |
|---|---|
| polyurethane resin | ppm 35 |
| dimethylformamide | ppm 65 |
| metal pigment | ppm 50 |

with a total solid contents of 43% and a viscosity in the range of 8–120,000 cP.

* * * * *